United States Patent [19]

Foster

[11] 3,970,255

[45] July 20, 1976

[54] SOLID WASTE SHREDDER

[75] Inventor: Harry C. Foster, Hagerstown, Md.

[73] Assignee: The Carborundum Company, Niagara Falls, N.Y.

[22] Filed: Aug. 15, 1974

[21] Appl. No.: 497,590

[52] U.S. Cl. ..... 241/186 R; 241/186.4; 241/188 R

[51] Int. Cl.[2] ..... B02C 13/18

[58] Field of Search ..... 241/46, 17, 56, 186 R, 241/186.2, 186.4, 188 R, 189 R

[56] References Cited

UNITED STATES PATENTS 3,851,829 12/1974 Döpper et al. ..... 241/188 R 3,868,064 2/1975 Coulter et al. ..... 241/186 R X

*Primary Examiner*—Roy Lake
*Assistant Examiner*—E. F. Desmond
*Attorney, Agent, or Firm*—David E. Dougherty; William H. Holt

[57] ABSTRACT

A solid waste shredder provided with rotating vanes for inducing a flow of air and/or solid waste through the shredder is particularly useful as a shredder for municipal and industrial trash and other solid waste prior to trash classification, pyrolysis, and landfill operations.

6 Claims, 10 Drawing Figures

SOLID WASTE SHREDDER

BACKGROUND OF THE INVENTION

This invention relates to a solid waste shredder and, more particularly, relates to a secondary shredder useful in the area of solid waste disposal wherein residential, municipal and industrial trash and solid wastes are reduced in size prior to pyrolysis or landfill operations. As such, the present invention is an improvement over such types of shredders or grinders more paticularly disclosed in U.S. Pat. No. 3,356,016 granted on Dec. 5, 1967.

BRIEF SUMMARY OF THE INVENTION

The invention relates to a solid waste shredder including a casing having an inlet and an outlet for passage of solid waste material into and through the casing. Disposed within the casing are means, such as grinding discs for shredding or masticating solid waste, the apparatus being provided with inducer means for supplying a motive force to introduce solid waste into the casing and force the waste therethrough during shredding operation.

More particularly, the invention relates to an improved solid waste shredder wherein the inducer means is comprised of a plurality of vanes adjustably fixed to an end cap member which, in turn, is fixedly secured to a rotary shaft which carries therewith the grinding discs, the latter being conventional in the prior art.

Further, the invention is more particularly concerned with adjustable mounting means useful for changing the angle of attack of the inducer vanes on the end cap member.

DETAILED DESCRIPTION OF THE INVENTION

Figure 1:
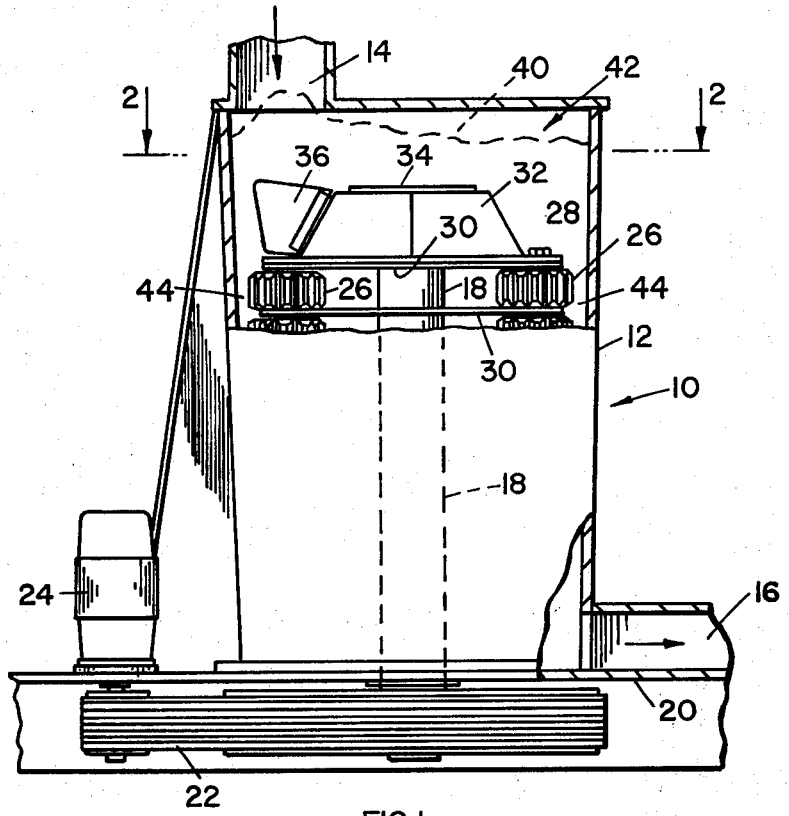
FIG. 1 is a fragmentary elevation view, partly in section, and shows one form of the invention wherein an end cap member is provided with vanes for inducing the flow of air and/or solid waste into the operative portion of a solid waste shredder.
Figure 2:
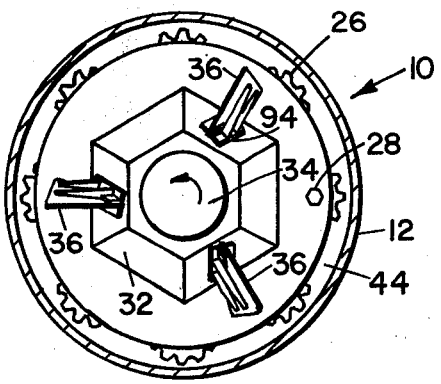
FIG. 2 is a fragmentary sectional view taken on line 2—2 of FIG. 1.

An improved solid waste shredder, generally indicated by the numeral 10, is shown in FIGS. 1 and 2 as including a hollow casing 12 having a top inlet 14 and a bottom outlet 16 for allowing solid waste to move into and exit from the casing 12. The shredder 10 includes a centrally disposed rotary shaft 18 which is suitably journaled in a bottom floor or plate member 20, the shaft 18 being driven by conventional drive belts 22 and a motor 24, the output of which may be on the order of 500 to 1000 horsepower.

The grinding or shredding operation occurs between the casing 12 and a plurality of gear-like grinding discs 26 which are journaled on a plurality of vertical posts or shafts 28 which are carried by a series of support plates 30, the latter being fixedly secure to the rotary shaft 18, all as more particularly described in the aforementioned U.S. Pat. No. 3,356,016.

An end cap member 32 is suitably bolted, or welded or otherwise fixedly secured to the top most portion of rotary shaft 18 for rotation therewith. Preferably, a cover plate 34 is removably secured to the end cap member 32 in order to provide access to the top of rotary shaft 18.

A particularly important part of the improved shredder 10 is the provision of a series of inducer vanes 36 which are secured to the end cap member 32 and are rotated therewith by rotary shaft 18. The function of the inducer vanes 36 is to provide a motive force which impels partially shredded solid waste outwardly toward the casing 12 and downwardly past the gear-like grinding discs 26 toward the outlet 16.

In operation, a quantity of partially shredded solid waste material, generally indicated by the broken line 40 at the top of FIG. 1, is introduced through inlet 14 into a receiving chamber portion 42 at the top of the shredder 10 above the inducer vanes 36 and end cap member 32. Motor 24 rotates shaft 18, through drive belt 22, and causes the support plates 30, the gear-like grinding discs 26, end cap member 32 and inducer vanes 36 all to rotate within the casing 12 so that the waste material is forced to move downwardly into a grinding zone 44 located between the casing 12 and the discs 26. It will be understood that the grinding zone 44 gradually decreases in size because the casing 12 is slightly conical and gradually converges toward the bottom thereof so that the waste material is gradually reduced in size prior to being discharged through outlet 16. Of course, gravity acts upon the material which is being masticated or shredded by the discs 26 but, with the provision of inducer vanes 36, the material is also forced and blown radially outwardly and downwardly through the shredding zone 44.

Figure 3:
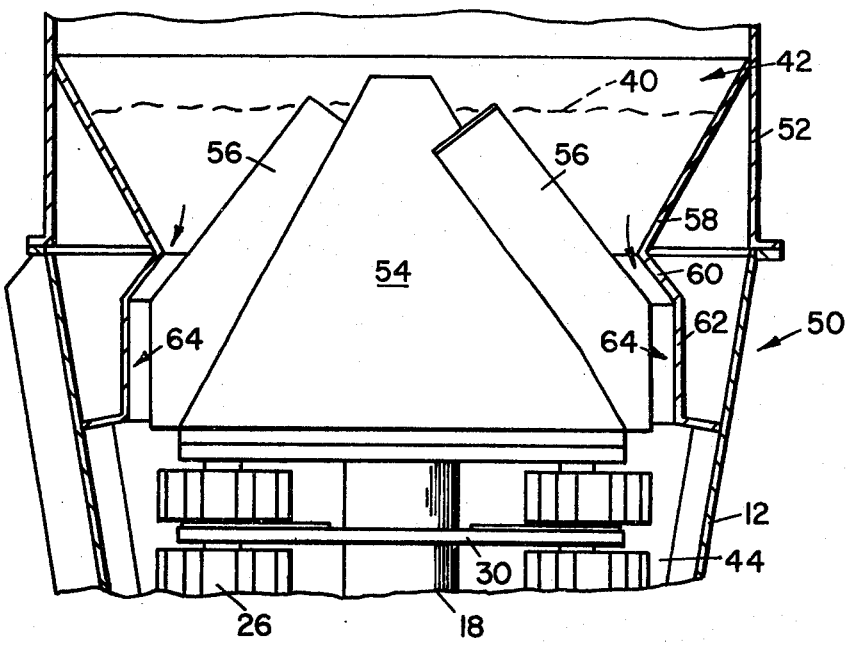
FIG. 3 is a fragmentary vertical section of a modified shredder similar to the showing in FIG. 1.

Referring to FIG. 3, wherein like numerals are used to indicate the same or correspondingly similar parts, a modified form of shredder, generally indicated by the numeral 50, is shown as being provided with an annular hood 52 which surrounds the receiving chamber 42. A modified form of end cap member 54 and inducer blades 56 are fixedly secured to rotary shaft 18 for rotation therewith in the receiving chamber 42. Surrounding the end cap member 54 is a series of guide plate members including a converging guide cone 58, a diverging guide cone 60 and an annular guide member 62, all of which define a reduced passageway 64 through which waste material is caused to flow by a combined action of gravity and motive force supplied by the inducer vanes 56.

As is shown in FIG. 4-9, inclusive, the end cap members and inducer vanes may take varying shapes and designs.

Figure 4:
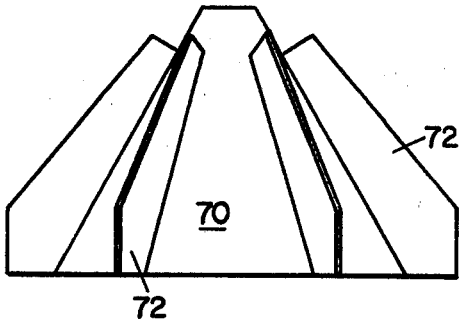
FIG. 4 is a fragmentary elevation view of the end cap member and vanes of FIG. 3.
Figure 5:
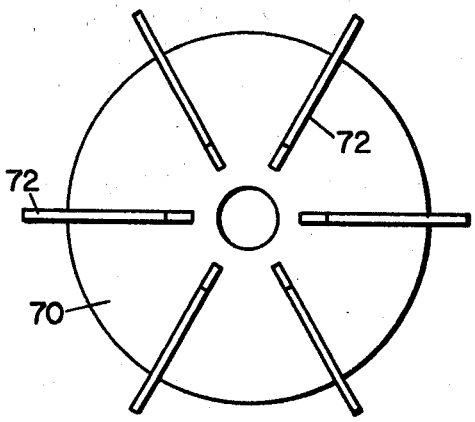
FIG. 5 is plan view of the end cap member and vanes of FIG. 3 and 4.

In FIGS. 4 and 5, frusto conical end cap member 70 may be provided with a series of inducer vanes 72 which are formed of flat stock, usually steel, and are disposed generally radially of and fixed to the conical surface of end cap member 72.

Figure 6:
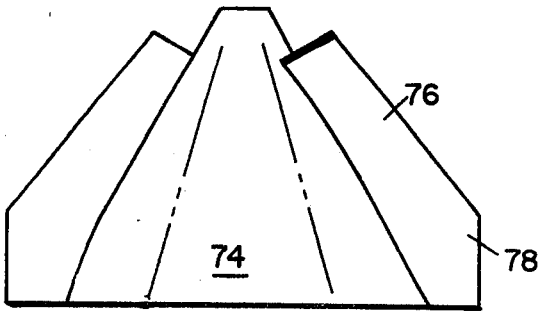
FIG. 6 is a fragmentary elevational view showing another modified form of end cap member and vanes.
Figure 7:
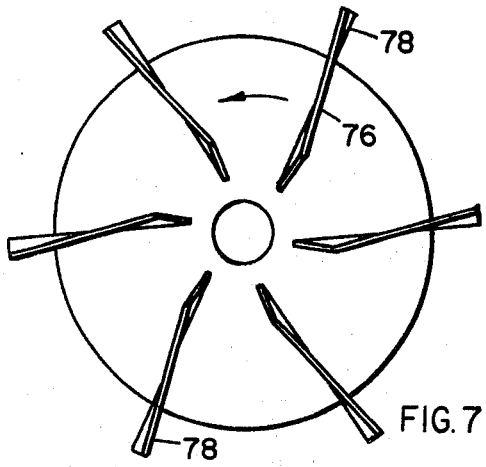
FIG. 7 is a fragmentary plan view of the end cap member and vanes shown in FIG. 6.

FIGS. 6 and 7 illustrate another version of end cap member 74 and inducer vanes 76, the latter having its bottom end portion 78 twisted or inclined forwardly in the direction of rotation for improving the aerodynamic characteristics of the vanes 76.

Figure 8:
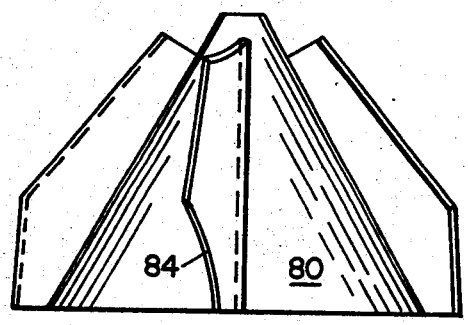
FIGS. 8 and 9 are fragmentary elevational and plan views, respectively, of still another modified form of end cap member and inducer vanes.
Figure 9:
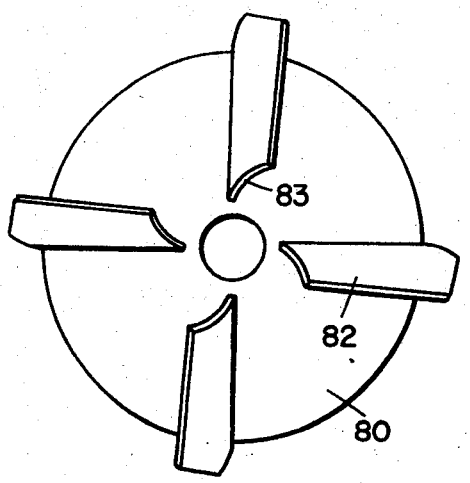

FIGS. 8 and 9 illustrate a still further modification wherein an end cap member 80 has a series of impeller vanes 82, the vanes 82 being formed of curved stock and having chamferred end portions 83 and 84 which are useful for minimizing jamming of solid waste during operation of the shredder.

Figure 10:
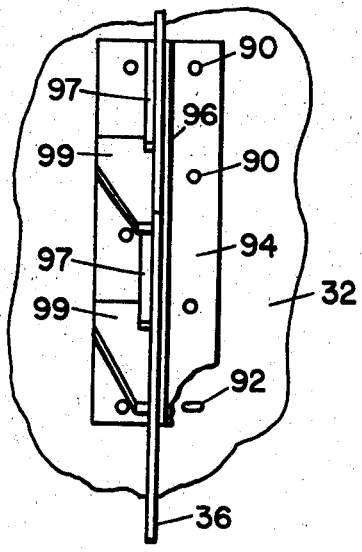
FIG. 10 is a fragmentary end view, partly in section, of one of the inducer vanes shown in FIG. 2.

FIG. 10 is an enlarged end view of one inducer vane 36 looking toward the center of FIGS. 1 or 2. The vane 36 is fixedly secured to the end cap member 32 by a series of threaded fasteners 90 located within elongated slots 92, the slots being oversized so that the vane 36 can be adjustably positioned relative to end cap member 32 to provide for changing the angle of attack and enhance the pumping action of the vanes. Typically, the vane 36 may be welded to a mounting plate 94 and braced by angle members 96 and 97 and is strengthened by elongated ribs 99, all of which may be welded and/or bolted together.

It will be appreciated by persons skilled in the art that the casing 12 becomes loaded with comminuted solid waste material as the material is progressively reduced in size near the bottom of the casing. As a result, the action of the inducer vanes on the upstream solid waste, in combination with the downwardly and outwardly sloping cap member 32, creates a pressure head which acts to pump or impel the solid waste and cause it to flow through the casing and past the grinding discs 26. Thus, the present invention very materially increases the throughput capacity of the improved shredder in relation to similar devices of the prior art which only utilize gravity to cause the shredded waste material to flow therethrough.

While the invention has been described herein with references to various preferred embodiments, it is to be understood that various changes and modifications may be made by those skilled in the art without departing from the spirit and scope of the invention as defined in the following claimed subject matter.

I claim:

1. A solid waste shredder comprising a casing having an inlet adjacent a top thereof and an outlet adjacent a bottom thereof for passage of solid waste into and through said casing, shredding means disposed within said casing for shredding said solid waste as it passes therethrough, and inducer means associated with said casing for impelling said solid waste downwardly toward said outlet, said induce means being comprised of vane means and motor means for rotating said vane means for creating a pressure head which impels said solid waste toward said outlet.

2. A solid waste shredder as defined in claim 1 wherein said shredder includes a shaft vertically disposed within said casing, and mounting means for fixing said vane means to said shaft.

3. A solid waste shredder as defined in claim 2 including means mounting said shaft for rotation within said casing, drive means connecting said motor means to said shaft for rotating said shaft and said vane means; a cap member, means mounting said cap member for rotation within said casing, said cap member being shaped to slope downwardly and outwardly, and means mounting said vane means on said cap member.

4. A solid waste shredder comprising a casing having an inlet and an outlet for passage of solid material into and through said casing, means disposed within said casing for masticating said solid waste, and inducer means for acting on said solid waste and causing a flow of solid waste through said casing, said inducer means including a cap member and at least one vane, motor means connected to said cap member for rotating said cap member about an axis thereof, and adjustable mounting means for mounting said vane on said cap member and for changing the angle of attack of said vane.

5. A solid waste shredder as defined in claim 4 wherein said inducer means is located adjacent said inlet said inlet means including a receiving chamber for said solid waste and means defining a reduced passageway from said receiving chamber and surrounding said vane.

6. A solid waste shredder as defined in claim 4 wherein said adjustable mounting means is comprised of elongated slot means formed in at least one of said cap member and said vane, and threaded fastener means disposed within said slot means and fixedly securing said vane to said cap member.

* * * * *